US011186997B2

(12) United States Patent
Ryberg

(10) Patent No.: US 11,186,997 B2
(45) Date of Patent: Nov. 30, 2021

(54) METHOD FOR FORMING A DÉCOR ON A SUBSTRATE

(71) Applicant: Valinge Innovation AB, Viken (SE)

(72) Inventor: Melker Ryberg, Malmö (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 16/085,277

(22) PCT Filed: Mar. 24, 2017

(86) PCT No.: PCT/SE2017/050284
§ 371 (c)(1),
(2) Date: Sep. 14, 2018

(87) PCT Pub. No.: WO2017/164806
PCT Pub. Date: Sep. 28, 2017

(65) Prior Publication Data

US 2019/0085569 A1 Mar. 21, 2019

(30) Foreign Application Priority Data

Mar. 24, 2016 (SE) ..... 1650392-2

(51) Int. Cl.
*E04F 15/10* (2006.01)
*B44C 5/04* (2006.01)
*B41M 5/00* (2006.01)

(52) U.S. Cl.
CPC ..... *E04F 15/107* (2013.01); *B44C 5/04* (2013.01); *B44C 5/043* (2013.01); *E04F 15/102* (2013.01); *B41M 5/0047* (2013.01); *E04F 2201/0107* (2013.01)

(58) Field of Classification Search
None
See application file for complete search history.

(56) References Cited

U.S. PATENT DOCUMENTS 3,210,302 A 10/1965 Bowell
4,554,200 A 11/1985 Caines
(Continued)

FOREIGN PATENT DOCUMENTS

BE 1018213 A3 7/2010
CA 2 626 218 A1 5/2007
(Continued)

OTHER PUBLICATIONS

U.S. Appl. No. 16/410,212, Pervan.
(Continued)

*Primary Examiner* — Shamim Ahmed
*Assistant Examiner* — Bradford M Gates
(74) *Attorney, Agent, or Firm* — Buchanan Ingersoll & Rooney P.C.

(57) ABSTRACT

A method for forming a décor on a substrate, including providing a substrate having a surface, forming at least one portion in the surface of the substrate having an extension in a plane situated lower than or above a plane of the surface of the substrate, and digital printing a décor on the surface of the substrate and on said at least one portion by a common print bar, wherein the décor is continuously extending over the surface of the substrate and said at least one portion. Also, a building panel and a set of building panels.

33 Claims, 4 Drawing Sheets

(56) References Cited

U.S. PATENT DOCUMENTS

| | | | | |
|---|---|---|---|---|
| 5,141,599 | A | 8/1992 | Jahn et al. | |
| 5,405,681 | A | 4/1995 | Nakayama et al. | |
| 5,486,231 | A | 1/1996 | Dulaney | |
| 5,989,701 | A | 11/1999 | Goetzen | |
| 6,087,416 | A | 7/2000 | Pearlstine et al. | |
| 6,270,214 | B1 | 8/2001 | Smith et al. | |
| 6,310,115 | B1 | 10/2001 | Vanmaele et al. | |
| 6,565,919 | B1 | 5/2003 | Hansson et al. | |
| 6,585,369 | B1 | 7/2003 | Sievert et al. | |
| 6,800,340 | B1 | 10/2004 | Francescutti | |
| 9,409,382 | B2 | 8/2016 | Hakansson et al. | |
| 9,605,168 | B2 | 3/2017 | Pervan | |
| 9,994,010 | B2 | 6/2018 | Pervan | |
| 10,017,950 | B2 | 7/2018 | Pervan | |
| 10,071,563 | B2 | 9/2018 | Pervan | |
| 10,328,680 | B2 | 6/2019 | Pervan | |
| 10,369,837 | B2 | 8/2019 | Ryberg | |
| 10,737,506 | B2 | 8/2020 | Pervan | |
| 10,899,121 | B2 | 1/2021 | Pervan | |
| 11,077,652 | B2 | 8/2021 | Pervan | |
| 2002/0061389 | A1 | 5/2002 | Brooker et al. | |
| 2003/0207083 | A1 | 11/2003 | Hansson et al. | |
| 2004/0061753 | A1 | 4/2004 | Chen | |
| 2004/0191547 | A1 | 9/2004 | Oldorff | |
| 2004/0250911 | A1 | 12/2004 | Vogel | |
| 2004/0266908 | A1 | 12/2004 | Marguerettaz et al. | |
| 2005/0193677 | A1 | 9/2005 | Vogel | |
| 2005/0247216 | A1 | 11/2005 | Reichwein et al. | |
| 2005/0249929 | A1 | 11/2005 | Reichwein et al. | |
| 2005/0259137 | A1 | 11/2005 | Moffat | |
| 2006/0179773 | A1 | 8/2006 | Pervan | |
| 2006/0194015 | A1* | 8/2006 | Sabater | B44F 3/00 428/60 |
| 2006/0236642 | A1 | 10/2006 | Pervan | |
| 2007/0058018 | A1 | 3/2007 | Ishibashi | |
| 2007/0059492 | A1 | 3/2007 | Oldorff | |
| 2007/0193174 | A1 | 8/2007 | Vogel | |
| 2007/0224438 | A1 | 9/2007 | Van Benthem et al. | |
| 2007/0283648 | A1 | 12/2007 | Chen | |
| 2008/0000179 | A1 | 1/2008 | Pervan et al. | |
| 2008/0048388 | A1 | 2/2008 | Gauss et al. | |
| 2008/0152825 | A1 | 6/2008 | Mukai et al. | |
| 2008/0152877 | A1 | 6/2008 | Mukai | |
| 2008/0176039 | A1 | 7/2008 | Chen et al. | |
| 2008/0252709 | A1 | 10/2008 | Ushiku | |
| 2009/0031662 | A1 | 2/2009 | Chen | |
| 2009/0038256 | A1 | 2/2009 | Thiers | |
| 2010/0091058 | A1 | 4/2010 | Hale et al. | |
| 2010/0196678 | A1 | 8/2010 | Vermeulen | |
| 2010/0231671 | A1 | 9/2010 | Liew et al. | |
| 2010/0285289 | A1* | 11/2010 | Nollet | B41F 7/04 428/211.1 |
| 2010/0300030 | A1 | 12/2010 | Pervan et al. | |
| 2010/0307675 | A1 | 12/2010 | Buhlmann | |
| 2010/0323187 | A1 | 12/2010 | Kalwa | |
| 2011/0012954 | A1 | 1/2011 | Brown et al. | |
| 2011/0135815 | A1 | 6/2011 | Ganapathiappan et al. | |
| 2011/0151148 | A1 | 6/2011 | Koenig | |
| 2011/0177354 | A1 | 7/2011 | Ziegler et al. | |
| 2011/0180202 | A1 | 7/2011 | Hirst et al. | |
| 2011/0189448 | A1 | 8/2011 | Lindgren et al. | |
| 2011/0200750 | A1 | 8/2011 | Meersseman et al. | |
| 2011/0234727 | A1 | 9/2011 | Aoki et al. | |
| 2011/0247748 | A1 | 10/2011 | Pervan et al. | |
| 2011/0250404 | A1 | 10/2011 | Pervan | |
| 2011/0273515 | A1 | 11/2011 | Takafumi et al. | |
| 2011/0286493 | A1 | 11/2011 | Torniainen | |
| 2011/0303113 | A1 | 12/2011 | Sarkisian et al. | |
| 2012/0015107 | A1 | 1/2012 | Schacht et al. | |
| 2012/0113193 | A1 | 5/2012 | Yamashita | |
| 2012/0147108 | A1 | 6/2012 | Ganapathiappan et al. | |
| 2012/0169808 | A1 | 7/2012 | Kiyomoto et al. | |
| 2012/0178844 | A1 | 7/2012 | Frey et al. | |
| 2012/0229885 | A1 | 9/2012 | Chen et al. | |
| 2012/0249705 | A1 | 10/2012 | Aoki et al. | |
| 2012/0288689 | A1 | 11/2012 | Hansson et al. | |
| 2012/0320137 | A1 | 12/2012 | Fujii et al. | |
| 2013/0045364 | A1 | 2/2013 | Sjöberg | |
| 2013/0062006 | A1 | 3/2013 | Meersseman et al. | |
| 2013/0063528 | A1 | 3/2013 | Govyadinov | |
| 2013/0067842 | A1 | 3/2013 | Meersseman et al. | |
| 2013/0122255 | A1 | 5/2013 | Chen | |
| 2013/0284391 | A1 | 10/2013 | Brinkmann | |
| 2013/0286088 | A1 | 10/2013 | Ryberg et al. | |
| 2013/0305649 | A1 | 11/2013 | Thiers | |
| 2014/0017452 | A1 | 1/2014 | Pervan | |
| 2014/0028772 | A1 | 1/2014 | Pervan | |
| 2014/0144583 | A1 | 5/2014 | Hakansson et al. | |
| 2014/0018661 | A1 | 7/2014 | Pervan | |
| 2014/0198168 | A1 | 7/2014 | Pervan et al. | |
| 2015/0064423 | A1 | 3/2015 | Ohmoto | |
| 2015/0167319 | A1 | 5/2015 | Saegart | |
| 2015/0184013 | A1 | 7/2015 | Double et al. | |
| 2015/0210055 | A1 | 7/2015 | Pervan | |
| 2015/0218395 | A1 | 8/2015 | Pervan | |
| 2016/0208121 | A1 | 7/2016 | De Mondt et al. | |
| 2016/0250835 | A1 | 9/2016 | Pervan | |
| 2016/0332479 | A1 | 11/2016 | Clement | |
| 2017/0152392 | A1 | 6/2017 | Pervan | |
| 2018/0133922 | A1 | 5/2018 | Herrmann et al. | |
| 2018/0319148 | A1 | 11/2018 | Pervan | |
| 2018/0354272 | A1 | 12/2018 | Pervan | |
| 2019/0263101 | A1 | 8/2019 | Pervan | |
| 2021/0008892 | A1 | 1/2021 | Pervan | |

FOREIGN PATENT DOCUMENTS

| | | | |
|---|---|---|---|
| CN | 101885200 | A | 11/2010 |
| CN | 102781677 | A | 11/2012 |
| CN | 102781677 | B | 7/2014 |
| DE | 101 56 956 | A1 | 6/2003 |
| DE | 10 2010 045 266 | A | 3/2012 |
| EP | 0 739 743 | A1 | 10/1996 |
| EP | 1 041 126 | A2 | 10/2000 |
| EP | 1 328 407 | | 5/2002 |
| EP | 1 242 702 | A1 | 9/2002 |
| EP | 1 314 766 | A1 | 5/2003 |
| EP | 1 403 343 | A1 | 3/2004 |
| EP | 1 242 702 | B1 | 11/2004 |
| EP | 1 577 354 | A2 | 9/2005 |
| EP | 1 577 354 | A3 | 9/2005 |
| EP | 1 762 671 | A1 | 3/2007 |
| EP | 1 328 407 | B1 | 8/2008 |
| EP | 1 980 598 | A1 | 10/2008 |
| EP | 1 454 763 | B1 | 8/2009 |
| EP | 2 202 056 | A1 | 6/2010 |
| EP | 2 313 281 | | 4/2011 |
| EP | 2 313 281 | B1 | 7/2012 |
| EP | 2 623 567 | A1 | 8/2013 |
| EP | 2 623 567 | B1 | 11/2014 |
| JP | 2001-254503 | A | 9/2001 |
| JP | 2008-265229 | A | 11/2008 |
| JP | 2012-077446 | | 4/2012 |
| WO | WO 01/47717 | A1 | 7/2001 |
| WO | WO 01/53387 | A1 | 7/2001 |
| WO | WO 2004/042168 | A1 | 5/2004 |
| WO | WO 2005/097874 | A2 | 10/2005 |
| WO | WO 2006/001880 | A2 | 1/2006 |
| WO | WO 2006/088417 | A2 | 8/2006 |
| WO | WO 2007/015669 | A2 | 2/2007 |
| WO | WO 2007/015669 | A3 | 2/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2009/097986 | A1 | 8/2009 |
| WO | WO 2009/116926 | A1 | 9/2009 |
| WO | WO 2009/124704 | A1 | 10/2009 |
| WO | WO 2010/084386 | A2 | 7/2010 |
| WO | WO 2010/084386 | A3 | 7/2010 |
| WO | WO 2010/087752 | A1 | 8/2010 |
| WO | WO 2011/103641 | A1 | 9/2011 |
| WO | WO 2011/105613 | A1 | 9/2011 |
| WO | WO 2011/129757 | A1 | 10/2011 |
| WO | WO 2011/146149 | A1 | 11/2011 |

(56) References Cited

FOREIGN PATENT DOCUMENTS

| | | | | |
|---|---|---|---|---|
| WO | WO 2012/004701 | A2 | 1/2012 | |
| WO | WO 2013/032387 | A1 | 3/2013 | |
| WO | WO 2013/179260 | A1 | 12/2013 | |
| WO | WO 2014/011110 | A1 | 1/2014 | |
| WO | WO 2014/017972 | A1 | 1/2014 | |
| WO | WO 2014/027179 | A1 | 2/2014 | |
| WO | WO 2014/084787 | A1 | 6/2014 | |
| WO | WO-2015058974 | A1 * | 4/2015 | ..... B32B 38/145 |
| WO | WO 2016/180643 | A1 | 11/2016 | |

OTHER PUBLICATIONS

Pervan, Darko, U.S. Appl. No. 16/410,212 entitled "Method of Forming a Decorative Wear Resistant Layer," filed in the U.S. Patent and Trademark Office on May 13, 2019.

Extended European Search Report issued in EP 17770717.1, dated Oct. 14, 2019, European Patent Office, Munich, DE, 11 pages.

International Search Report and Written Opinion issued in corresponding PCT/SE2017/050284, dated Jun. 27, 2017, ISA/SE, Stockholm, SE, 19 pages.

Pervan, Darko, et al., Technical Disclosure entitled Digital Printing and Embossing, IP.com No. IPCOM000224950D, IP.com PriorArtDatabase, Jan. 15, 2013, 89 pages (XP13155608 A).

Pervan, Darko, Technical Disclosure entitled "Digital Overlay," IP.com No. IPCOM000225271D, IP.com PriorArtDatabase, Feb. 5, 2013, 24 pages (XP 13155893 A).

U.S. Appl. No. 16/864,411, Pervan.

Pervan, Darko, U.S. Appl. No. 16/864,411 entitled "Digital Print with Water-Based Ink," filed in the U.S. Patent and Trademark Office on May 1, 2020.

* cited by examiner

METHOD FOR FORMING A DÉCOR ON A SUBSTRATE

FIELD OF THE INVENTION

The present invention relates methods for forming a décor on a substrate, a building panel, and a set of building panels having a décor.

TECHNICAL BACKGROUND

In recent years, digital printing has offered new possibilities in the flooring industry to customize decorative patterns for flooring applications.

Instead of printing large quantities of décor paper with a decorative pattern by rotogravure or direct printing, digital printing offers a possibility to print small quantities of décor papers. Thereby, the digital printing technique offers a possibility to create a large number of different patterns and to customize patterns.

Digital printing has been used to form decorative patterns for laminate floorings and thermoplastic floorings but also on wooden floorings in order to form a fantasy pattern on the surface or to print a natural wood pattern, for example, to change the appearance of the wood surface.

By digital printing is conventionally meant printing by means of a non-contact printing method, for example, using a Drop-on-Demand (DOD) technique. A drop of ink is placed with great accuracy on a paper or wood surface. Examples of DOD techniques are piezoelectric DOD inkjet and thermal DOD inkjet. In a piezoelectric (or Piezo) DOD inkjet printer, the piezoelectric material changes shape when a voltage is applied. The change of shape of the piezoelectric material generates a pressure pulse in the fluid, thereby ejecting a droplet of ink from the nozzle. In a thermal DOD inkjet printer, ink drops are ejected by forming an ink vapour bubble by heating the ink.

Different kind of inks may be used for digital printing, such as UV curable inks, solvent based inks and aqueous inks (also called waterborne or water based inks). The colorants may be pigments or dyes.

Flooring panels are often provided with bevels, grout lines, embossing, etc. When printing on such surface portions not being horizontal, ink drops may even not bind the portions of the surface not being horizontal, resulting in that no décor is present on such surface portions, for example a bevel, grout line, etc. This problem is sometimes referred to as printing shadows.

US 2011/0200750 discloses that a flat side of a panel as well as the surface of one or more chamfers provided on an edge of the panel can be provided with a printed with a printed décor by means of the same printing operation. The print is printed by a printing device with moving inkjet print heads. The design and relation of the décors of the different portions are not disclosed.

EP 1 762 761 discloses a building panel, in particular a flooring panel of wooden material. At least one side surface of the building board and at least one connecting mechanism of the building board are provided with a pattern.

SUMMARY

It is an object of at least embodiments of the present invention to provide an improvement over the above described techniques and known art.

A further object of at least embodiments of the present invention is to improve the visual impression of digitally printed décors on building panels, especially building panels intended to be connected side by side.

A further object of at least embodiments of the present invention is to visually hide joints between two different building panels.

A further object of at least embodiments of the present invention is to improve a method of forming bevels, grout line, embossed etc., on a digitally printed building panel, and to improve the visual impression of a digitally printed building panel with bevels, grout lines, embossed portions, etc.

At least some of these and other objects and advantages that will be apparent from the description have been achieved by a method for forming a décor on a substrate according to a first aspect of the invention. The method comprises providing a substrate having a surface, forming at least one portion in the surface of the substrate having an extension in a plane situated lower than or above a plane of the surface of the substrate, and digital printing a décor on the surface of the substrate and on said at least one portion by a common print bar, wherein the décor is continuously extending over the surface of the substrate and said at least one portion.

In the following description, claims and examples, directions are described as when the surface of the substrate is positioned as extending in a horizontal direction. The plane of the surface of the substrate may be a main plane of the surface. The plane of the surface of the substrate may be an uppermost plane of the surface.

At least a portion of the surface of the substrate is printed with said décor. Preferably, a major part of the surface of the substrate is printed with said décor. The décor may cover the whole surface of the substrate.

The digitally printed décor is present on said at least one portion.

The substrate may have a rectangular shape, such as a plank or tile. The substrate may be, or form part of, a building panel such as a floor panel, a wall panel, a ceiling panel, a furniture component, worktop, etc.

The surface of the substrate and said at least one portion may be printed by a common print bar in one printing operation.

An advantage of at least embodiments of the present invention is that improved matching of the décor is obtained, as the décor continuously extends of the surface of the substrate and said portion, for example, being a bevel, a grout line, embossed portion, protruding portion etc. Thereby, the print is synchronized between such portion and surrounding surfaces. Furthermore, an improved colour matching is obtained by printing the décor on the surface and any such portion in one printing operation.

Furthermore, turbulence during the print operation provides that ink drops may even bind to a vertical surface, for example a vertical surface of a bevel, grout line, embossing, protruding portion, or of a mechanical locking system.

It is an advantage to print the décor a with a single-pass print heads, i.e. with a fixedly arranged array of print heads. If printing with a multi-pass printer, so-called printing shadows may occur, especially at inclined portions of the surface. When printing with a single-pass printer, turbulence occurs, thereby at least reducing problems associated with so-called printing shadows.

The same décor file may be printed on said surface and said at least one portion.

Said at least one portion in the surface of the substrate may have an extension in a direction being inclined in relation to the surface of the substrate. At least a part of the digitally printed décor is present on the inclined portion. At least some ink drops ejected from a print head of the print bar bind to the inclined portion. The inclined portion may be extending in a direction substantially perpendicular to the surface of the substrate. The inclined portion may, for example, be an edge surface of the substrate such as a bevel, and/or be a surface of a mechanical locking system.

Said at least one portion may form a bevel along an edge of the substrate. The substrate may be provided with bevels along two opposite edges, or may be provided with bevels on four edges.

The bevel may have a convex shape. By the bevel having a convex shape, the portion of the bevel located adjacent the plane of the surface, and thereby located substantially at the same distance from the print heads, is comparable large compared to the portion of the bevel located further away from the plane of the surface. Thereby, colour variations and/or printing shadows may be at least reduced. Further, the variation in colour that may occur due to the difference in distance between the portions is more difficult to perceive for the human eye, for example, as the lower portion of the bevel is shadowed when located at a distance from the plane of the surface.

Said at least one portion may form an embossed portion in the surface of the substrate. The substrate may be provided with several embossed portions.

Said at least one portion may form a grout line in the surface of the substrate. The grout line may, for example, have a circular, rectangular, or V-shaped cross section.

Said at least one portion may form a protruding portion in the surface of the substrate.

The substrate may comprise a core and a surface layer arranged on the core, wherein the surface layer forms the surface of the substrate.

The at least one portion may be formed in the surface layer only. The at least one portion may extend into the surface layer only. In this embodiment, the at least one portion does not extend into the core.

The print bar may be positioned at a fixed distance in a vertical direction from a main plane of the surface. By vertical is meant in a direction perpendicular to the surface of the substrate.

The print bar may be fixedly arranged, i.e. being a single-pass printer. The print bar may be stationary. The print heads may be stationary. When printing with a multi-pass printer, a Doppler effect may occur, since when the print head passes for example a bevel in a direction perpendicular to the lengthwise extension of the bevel, ink drops are accumulated on the bevel. When the print head moves back in the opposite direction, the ink drops on the bevel may be stretched out. This effect may at least be reduced by printing with a stationary print bar, and thereby stationary print heads.

A traditional multi-pass printer has typically small drops, e.g. 2-3 picolitres. These heads often have drop velocities below 8 m/s. The resulting drop mass momentum is consequently quite low and requires a minimized printing stand-off, often about 1 mm. If the printing height is increased further then this will result in a change of colour tone and precision of the print. Always when printing, the printing height needs to be adjusted to the uppermost protruding portions of the surface. A safe distance for a completely non-warped board would be 1 mm. However, if the bevels and protruding portions are e.g. 1 mm, this will then result in poor print result in these areas, since the local resulting printing stand-off will be 2 mm. A solution is then to increase the mass momentum such that an increased stand-off can be used. The mass momentum can be increased by either increasing the drop size or the ejection speed, or the combination thereof. It has been identified that 10-30 picolitres will still give an optically good printing result without getting a dotted impression of the print. In order to further improve the stand off, the drop velocity may be increased to 8 m/s or even more. With this it will be possible to jet from a distance of 2 mm and more, even up to 6 mm.

The distance may be about 2 mm in the vertical direction form the main plane of the surface, or preferably exceed 2 mm. In embodiments, a sufficient resolution of the print is preserved, as well as the colour tone of the print, even if the distance is 2 mm or more in the vertical direction from a main plane of the surface. If the surface comprises embossed portions and/or bevels, the distance in the vertical direction is even larger at such embossed portions and/or bevels. If the distance is too large, for example, exceeding 5 mm, an undesired spraying effect may occur due to the large distance.

A drop velocity of print heads of the print bar may exceed 8 m/s. By the drop velocity of the ink drops ejected from the print heads exceeding 8 m/s, it is possible to print on surfaces positioned on different distances from the print head. Ink drops can be positioned at inclined surfaces such as bevel, embossed portions and substantially vertical portions. Turbulence may further facilitate for the ink drops to bond on a vertical surfaces.

A drop volume of print heads of the print bar may be 10-30 picolitres.

In one embodiment, a drop volume of print heads of the print bar is 10-30 picolitres and the print bar is positioned at a distance of at least 2 mm in a vertical direction from a main plane of the surface. By combining a drop volume of 10-30 picolitres with a distance of at least 2 mm, a sufficient resolution of the print is preserved, as well as the colour tone of the print.

If the surface of the substrate comprises embossed portions and/or protrusions, the distance to the main plane of the surface has to be adjusted. If the surface includes protrusions, the distance has to be adjusted such that the protrusions do not come in contact with the print heads. Thereby, the distance to the main plane of surface of the substrate has to increase, and the distance the surface of any embossed portions increases even more. In order to obtain a desired print quality, print parameters such as the drop volume have to be adjusted.

The print bar may comprise inkjet print heads. The print bar may comprise one or several Piezo print heads. The print heads may be single-pass or multi-pass.

The ink may be an aqueous ink, a solvent-borne ink, or a UV based ink.

The ink may be a pigment based ink or a dye based ink. CMYK and/or other spot colours may be used.

The surface may comprise a wood veneer, solid wood, a wood-based material, a thermoplastic foil, a co-extruded thermoplastic layer, a paper, non-woven, wallpaper, etc. The substrate may be solid, or may comprise a surface layer and a core, wherein the surface layer is arranged on the core and forms the surface of the substrate. The core may comprise be a wood-based board, for example, a wood-fibre based board such as MDF or HDF, plywood, or lamella core. The core may be a Wood Plastic Composite (WPC). The core may be a mineral composite board. The core may be a fibre cement board. The core may be magnesium oxide cement board. The core may be a plastic board such as a thermoplastic board. The core may be formed of solid wood. The surface layer may comprise a wood veneer, solid wood, a wood-based material, a thermoplastic foil, a co-extruded thermoplastic layer, a paper, non-woven, wallpaper, etc.

The method may further comprise forming a mechanical locking system at least one edge of the substrate prior to printing. The mechanical locking system is adapted to connect the adjacent substrates as building panels to each other in at least one direction. The mechanical locking system may comprise a tongue and groove.

The method may further comprise digitally printing on at least one surface of the mechanical locking system. The at least one surface of the locking system may be horizontally and/or vertically extending. The at least one surface of the locking system may be formed in the core. By printing on portions of the mechanical locking system, the visual impression of the mechanical locking system may be hidden such that the joint is less visible. The joint between adjoining building panels may be hidden. Further, by printing on a surface of the mechanical locking system, a substrate comprising a surface layer and a core of different material, the substrate may obtain a visual impression similar to a solid substrate, for example, a solid wood substrate. For example, a MDF or HDF core with a surface layer of wood veneer may look like a solid substrate. The bevel may be formed of a material being different from the rest of the surface of the substrate.

The mechanical locking system may comprise a tongue at at least one edge of the substrate, and wherein the step of digital printing comprising printing said décor on the tongue with the common print bar, wherein the décor is continuously extending over the surface of the substrate, said at least one portion and the tongue. Thereby, the substrate may look like a solid substrate even if the substrate comprises a surface layer and a core of different materials.

In the method, the step of forming at least one portion may comprise forming a first portion in the surface of the substrate having an extension in a plane situated lower than or above a plane of the surface of the substrate and forming a second portion in the surface of the substrate having an extension in a plane situated lower than or above a plane of the surface of the substrate, wherein the first and the second portion are separated by a predetermined distance forming a gap, and the step of digital printing a décor comprises digital printing the décor on the surface of the substrate, said first portion and said second portion by the common print bar, wherein the décor on said first portion is synchronized with the décor on said second portion such that the décor of the first portion continuously extends into the décor of the second portion.

Thereby, it is possible to print the substrate in one step and after printing divide the substrate into panels at the gap. The décor is printed such that after dividing the substrate into panels, the décor of the panels matches such that the décor of a first panel continuously extends into the décor of a second panel. As the décor continuously extends from the first panel to the second panel, the visual impression of the joint between the first and second panel is diminished, such that the joint is visually hidden.

No décor may be printed in the gap.

The method may further comprise dividing the substrate at said gap for forming a first and second panel.

The method may further comprise forming a mechanical locking system at said gap. The predetermined distance may correspond to the horizontal extension of the mechanical locking system. Thereby, after forming the mechanical locking system is formed, when the panels are joined, the décor of the first panel continuously extends into the décor of the second panel and the décor of the first panel is synchronized with the second panel.

The first portion may be provided along an edge of the first panel and the second portion is provided along an edge of the second panel.

The method may further comprise joining the first and second panel by means of the mechanical locking system, wherein the décor of the first portion is synchronized with the décor of the second portion and continuously extends into the décor of the second portion after joining.

According to a second aspect of the present invention, a building panel is provided. The building panel comprises a substrate having a surface, at least one portion in the surface of the substrate having an extension in a plane situated lower than or above a plane of the surface of the substrate, wherein the surface and said at least one portion are provided with a décor, wherein the décor is continuously extending over the surface of the substrate and said at least one portion.

Embodiments of the second aspect of the present invention incorporates all the advantages of the first aspect of the invention, which previously has been discussed, whereby the previous discussion is applicable also for the building panel.

The building panel may be a floor panel, a wall panel, a ceiling panel, a furniture component, worktop, etc.

The plane of the surface of the substrate may be a main plane of the surface. The plane of the surface of the substrate may be an uppermost plane of the surface.

The same décor file may be printed on said surface and said at least one portion.

Said at least one portion in the surface of the substrate may have an extension in a direction being inclined in relation to the surface of the substrate. At least a part of the digitally printed décor is present on the inclined portion. At least some ink drops ejected from a print head of the print bar bind to the inclined portion. The inclined portion may be extending in a direction substantially perpendicular to the surface of the substrate. The inclined portion may, for example, be an edge surface of the substrate, and/or be a surface of a mechanical locking system.

Said at least one portion may form a bevel along an edge of the substrate. The substrate may be provided with bevels along two opposite edges, or may be provided with bevels on four edges.

The bevel may have a convex shape. By the bevel having a convex shape, the portion of the bevel located adjacent the plane of the surface, and thereby located substantially at the same distance from the print heads, is comparable large compared to the portion of the bevel located farther away from the plane of the surface. Thereby, colour variations and/or printing shadows may be at least reduced. Further, the variation in colour that may occur due to the difference in distance between the portions is more difficult to perceive for the human eye, for example, as the lower portion of the bevel is shadowed when located at a distance from the plane of the surface.

Said at least one portion may form an embossed portion in the surface of the substrate. The substrate may be provided with several embossed portions.

Said at least one portion may form a grout line in the surface of the substrate. The grout line may, for example, have a circular, rectangular, or V-shaped cross section.

Said at least one portion may form a protruding portion in the surface of the substrate.

The substrate may comprise a core and a surface layer arranged on the core, wherein the surface layer forms the surface of the substrate.

The at least one portion may be formed in the surface layer only. The at least one portion may extend into the surface layer only. In this embodiment, the at least one portion does not extend into the core.

The surface may comprise a wood veneer, solid wood, a wood-based material, a thermoplastic foil, a co-extruded thermoplastic layer, a paper, non-woven, wallpaper, etc. The substrate may be solid, or may comprise a surface layer and a core, wherein the surface layer is arranged on the core and forms the surface of the substrate. The core may comprise be a wood-based board, for example, a wood-fibre based board such as MDF or HDF, plywood, or a lamella core. The core may be a Wood Plastic Composite (WPC). The core may be a mineral composite board. The core may be a fibre cement board. The core may be magnesium oxide cement board. The core may be a plastic board such as a thermoplastic board. The core may be formed of solid wood. The surface layer may comprise a wood veneer, solid wood, a wood-based material, a thermoplastic foil, a co-extruded thermoplastic layer, a paper, non-woven, wallpaper, etc.

The building panel may comprise a mechanical locking system. The mechanical locking system is adapted to connect the adjacent substrates as building panels to each other in at least one direction. The mechanical locking system may comprise a tongue and groove. At least one surface of the mechanical locking system may be printed. The décor may continuously extend over the surface and over the at least one surface of the mechanical locking system. The at least one surface of the locking system may be horizontally and/or vertically extending. The at least one surface of the locking system may be formed in the core. By printing on portions of the mechanical locking system, the visual impression of the mechanical locking system may be hidden such that the joint is less visible. The joint between adjoining building panels may be hidden. Further, by printing on a surface of the mechanical locking system, a substrate comprising a surface layer and a core of different material, the substrate may have a visual impression similar to a solid substrate, for example, a solid wood substrate. For example, a MDF or HDF core with a surface layer of wood veneer may look like a solid substrate. The bevel may be formed of a material being different from the rest of the surface of the substrate.

According to a third aspect of the present invention, a method of forming a décor on a substrate is provided. The method comprises:

providing a substrate having a surface, digital printing a décor on a first portion and a second portion of said surface, wherein the first and second portions are separated by a predetermined distance forming a gap, wherein the décor continuously extends over the first portion of said surface to the second portion of said surface, and wherein the décor of the first portion is synchronized with the décor of the second portion.

Advantages of at least embodiments of the second aspect of the invention is to print the substrate in one step and after printing divide the substrate into panels at the gap. The décor is printed such that after dividing the substrate into panels, the décor of the panels matches such that the décor of a first panel continuously extends into the décor of a second panel. As the décor continuously extends from the first panel to the second panel, the visual impression of the joint between the first and second panel is diminished, such that the joint is visually hidden. Thereby, the impression of the panels can be controlled by the décor and not of the size of the panels. The impression of wide planks can be created. For example, the impression of a wide plank having a width and/or length exceeding the width and/or length of the individual panel can be created.

The substrate may be, or form part of, a building panel. The building panel may be a floor panel, a wall panel, a ceiling panel, a furniture component, worktop, etc.

The plane of the surface of the substrate may be a main plane of the surface. The plane of the surface of the substrate may be an uppermost plane of the surface.

The décor on the first and second portion may be printed by at least one common print bar.

No décor may be printed in the gap.

The same décor file may be printed on the first and second portion of the surface.

The method may further comprise dividing the substrate at said gap for forming a first and second panel. The substrate is divided at the gap after printing the décor. Machining takes place after printing.

The method may further comprise forming a mechanical locking system at said gap.

The predetermined distance may correspond to the horizontal extension of the mechanical locking system. Thereby, after forming the mechanical locking system, when the panels are joined, the décor of the first panel continuously extends into the décor of the second panel and the décor of the first panel is synchronized with the décor of the second panel.

The method may further comprise connecting the first and second panel by means of the mechanical locking system, wherein the décor of the first edge portion is synchronized with the décor of the second edge portion and continuously extends into the décor of the second edge portion after joining.

The print bar may be positioned at a fixed distance in a vertical direction from a main plane of the surface. By vertical is meant in a direction perpendicular to the surface of the substrate.

The print bar may be fixedly arranged, i.e. being a single pass printer. The print bar may be stationary. The print heads may be stationary. When printing with a multi-pass printer, a Doppler effect may occur, since when the print head passes for example a bevel in a direction perpendicular to the lengthwise extension of the bevel, ink drops are accumulated on the bevel. When the print head moves back in the opposite direction, the ink drops on the bevel may be stretched out. This effect may at least be reduced by printing with a stationary print bar, and thereby stationary print heads.

A traditional multi-pass printer has typically small drops, e.g. 2-3 picolitres. These heads often have drop velocities below 8 m/s. The resulting drop mass momentum is consequently quite low and requires a minimized printing stand-off, often about 1 mm. If the printing height is increased further then this will result in a change of colour tone and precision of the print. Always when printing, the printing height needs to be adjusted to the uppermost protruding portions of the surface. A safe distance for a completely non-warped board would be 1 mm. However, if the bevels and protruding portions are e.g. 1 mm, this will then result in poor print result in these areas, since the local resulting printing stand-off will be 2 mm. A solution is then to increase the mass momentum such that an increased stand-off can be used. The mass momentum can be increased by either increasing the drop size or the ejection speed, or the combination thereof. It has been identified that 10-30 picolitres will still give an optically good printing result without getting a dotted impression of the print. In order to further improve the stand off, the drop velocity may be increased to 8 m/s or even more. With this it will be possible to jet from a distance of 2 mm and more, even up to 6 mm.

In one embodiment, a drop volume of print heads of the print bar is 10-30 picolitres and the print bar is positioned at a distance of at least 2 mm in a vertical direction from a main plane of the surface. By combining a drop volume of 10-30 picolitres with a distance of at least 2 mm, a sufficient resolution of the print is preserved, as well as the colour tone of the print.

A drop velocity of print heads of the print bar may exceed 8 m/s. By the drop velocity of the ink drops ejected from the print heads exceeding 8 m/s, it is possible to print on surfaces positioned at different distances from the print head. Ink drops can be positioned on inclined surfaces such as bevels, grout lines, embossed portions and substantially vertical portions. Turbulence may further facilitate for the ink drops to bond on a vertical surfaces.

A drop volume of print heads of the print bar may be 10-30 picolitres. In one embodiment, a drop volume of print heads of the print bar is 10-30 picolitres and the print bar is positioned at a distance of at least 2 mm in a vertical direction from a main plane of the surface. By combining a drop volume of 10-30 picolitres with a distance of at least 2 mm, a sufficient resolution of the print is preserved, as well as the colour tone of the print.

The print bar comprises inkjet print heads. The print bar may comprise one or several Piezo print heads. The print heads may be single-pass or multi-pass.

The ink may be an aqueous ink, a solvent-borne ink, or a UV based ink.

The ink may be a pigment based ink or a dye based ink. CMYK and/or other spot colours may also be used.

The surface may comprise a wood veneer, solid wood, a wood-based material, a thermoplastic foil, a co-extruded thermoplastic layer, a paper, non-woven, wallpaper, etc. The substrate may be solid, or may comprise a surface layer and a core, wherein the surface layer is arranged on the core and forms the surface of the substrate. The core may comprise be a wood-based board, for example, a wood-fibre based board such as MDF or HDF, plywood, or a lamella core. The core may be a Wood Plastic Composite (WPC). The core may be a mineral composite board. The core may be a fibre cement board. The core may be magnesium oxide cement board. The core may be a plastic board such as a thermoplastic board. The core may be formed of solid wood. The surface layer may comprise a wood veneer, solid wood, a wood-based material, a thermoplastic foil, a co-extruded thermoplastic layer, a paper, non-woven, wallpaper, etc.

According to a fourth aspect, a set of building panels is provided. The set of building panels comprises a first panel and a second panel, wherein the first panel and the second panel are provided with a digitally printed décor, and wherein the décor the first panel and the décor of the second panel is synchronized such that the décor is continuously extending over the first panel to the second panel when the first and second panels are joined, said first edge to said second edge.

Advantages of at least embodiment of the fourth and fifth aspects of the invention is that the visual impression the joint between the first and second panel is diminished, such that the first and second panel are perceived as one panel. The joint is more or less invisible since the décor continuously extends over the first and second panel. Thereby, the impression of the panels can be controlled by the décor and not by the size of the panels. The impression of wide planks can be created. For example, the impression of a wide plank having a width exceeding the width of the individual panel can be created. Conventionally, such wide planks having a width exceeding, for example, 15 cm are expensive to produce. Additionally, such wide planks may be difficult to handle during installation due to their size. Also the weight of wide planks may be a drawback during installation and transportation. By creating the impression of wide planks by using more narrow panels according to embodiments of the present invention overcomes, or at least reduces, the drawbacks above.

Preferably, the panels are displaced in a lengthwise direction in order to reduce a visual impression of repetition or for the purpose of creating a décor larger than the format of the individual boards.

A short side of a first panel is preferably installed with a distance to a short side of a second panel exceeding at least half the width of the short side. More preferably, a short side of a first panel is installed with a distance to a short side of a second panel corresponding to or exceeding the width of the short side. The distance is measured along the connected long sides between said panels. The décors shall in this case be offset on the panels such that the décors synchronize when installed, extending from the first panel to the second panel. Thereby, stress on the panel in the corner between the long and the short side when walked upon is reduced.

Thereby, the impression of wide planks having a length and width exceeding the length and width of the individual panels can be created. For example, logos and artistic surface coverings may be formed, having a size exceeding a size of an individual panel.

The surface may comprise a wood veneer, solid wood, a wood-based material, a thermoplastic foil, a co-extruded thermoplastic layer, paper, non-woven, wallpaper, etc. The substrate may be solid, or may comprise a surface layer and a core, wherein the surface layer is arranged on the core and forms the surface of the substrate. The core may comprise be a wood-based board, for example, a wood-fibre based board such as MDF or HDF, plywood, or a lamella core. The core may be a Wood Plastic Composite (WPC). The core may be a mineral composite board. The core may be a fibre cement board. The core may be magnesium oxide cement board. The core may be a plastic board such as a thermoplastic board. The surface layer may comprise a wood veneer, solid wood, a wood-based material, a thermoplastic foil, a co-extruded thermoplastic layer, a paper, non-woven, wallpaper, etc.

The panels may be provided with a bevel along at least one edge.

At least one edge of the panels may comprise a mechanical locking system. The mechanical locking system may comprise at least a tongue and a tongue groove. The first edge of the first panel may be provided with a tongue, and the second edge of the second edge may be provided with a tongue groove.

According to a fifth aspect, a set of building panels is provided. The set of building panels comprises:

a first panel having a first bevel along a first edge of the first panel, a second panel having a second bevel along a second edge of the second panel, wherein the first panel is adapted to be joined to the second panel, said first edge to said second edge, wherein the first panel and the second panel are provided with a digitally printed décor, and wherein the décor of the first bevel of the first panel and the second bevel of the second panel is synchronized such that the décor is continuously extending over the first panel to the second panel when the first and second panel are joined, said first edge to said second edge.

The set of building panels may further comprise a third panel having a third bevel along a third edge of the third panel, wherein the first panel further comprises a fourth bevel along a fourth edge of the first panel, and wherein the first, second, and third panel are provided with the digitally printed décor, wherein the décor of the first bevel of the first panel and the second bevel of the second panel is synchronized, the décor of the fourth bevel of the first panel and the third bevel of the third panel is synchronized, such that the décor is continuously extending over the first panel to the second panel and to the third panel when the panels are joined, said first edge of the first panel to said second edge of the second panel and said fourth edge of the first panel to said third edge of the third panel.

BRIEF DESCRIPTION OF THE DRAWINGS

The present invention will by way of example be described in more detail with reference to the appended schematic drawings, which show embodiments of the present invention.

DETAILED DESCRIPTION

In the description below, all directions are related to when a substrate is arranged such that the substrate has a main extension in a horizontal plane.

Figure 1:
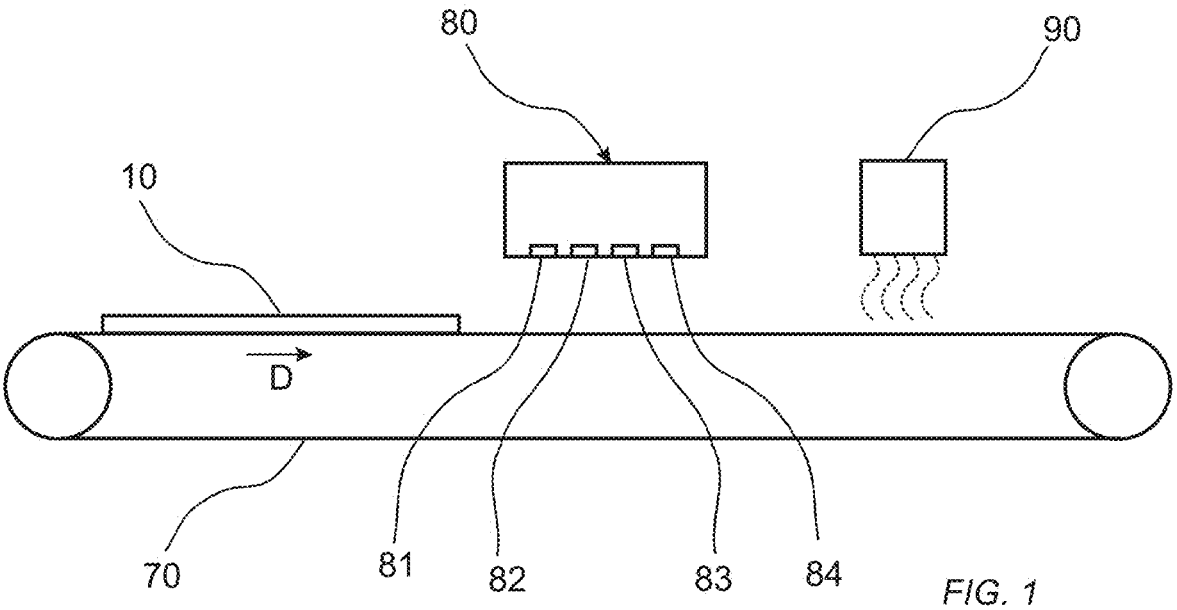
FIG. 1 shows a printing line for printing a décor on a substrate.

FIG. 1 illustrates a method of forming a décor on a substrate 1. The method comprises providing the substrate 1 having a surface 2. The surface 2 may comprise a wood veneer, solid wood, a wood-based material, a thermoplastic foil, a co-extruded thermoplastic layer, a paper, non-woven, wallpaper, etc. The substrate 1 may be solid, or may comprise a surface layer and a core, wherein the surface layer is arranged on the core and forms the surface of the substrate. The core may comprise be a wood-based board, for example, a wood-fibre based board such as MDF or HDF, or plywood. The core may be a Wood Plastic Composite (WPC). The core may be a mineral composite board. The core may be a fibre cement board. The core may be magnesium oxide cement board. The core may be a plastic board such as a thermoplastic board. The core may be formed of solid wood. Examples of suitable thermoplastic materials for the surface and/or the core is polyvinyl chloride (PVC), polypropylene (PP), and/or polyethylene (PE).

The substrate 1 may be a board prepared for printing, for example, a wood-based board with a surface coated with a layer adapted to receive a print.

Prior to printing on the surface 2 of the substrate 1, at least one portion in the surface 2 of the substrate 1 having an extension in a plane situated lower than a plane of the surface 2 of the substrate 1 is formed. The at least one portion may comprise a portion being inclined in relation to the surface 2 of the substrate 1. At least one component of said portion has an extension in a plane lower than the plane of the surface 2 of the substrate 1. A portion being inclined includes a component having an extension in a plane lower than the plane of the surface 2 of the substrate 1. The at least one portion may be bevel, an embossed portion, a grout line, etc., which will be described in more detail with reference to FIGS. 2-7.

The at least one portion may be formed by any method (not shown) such as pressing, embossing, brushing, machining, profiling, sanding, scarping, or any other type of machining prior to printing on the surface of the substrate.

By printing at a distance from the substrate 1 being larger than conventional, the substrate may be brushed prior to printing. Any fibre swelling will not disturb the printing operation.

In FIG. 1, a printing line for printing a décor on a substrate 1 is shown, arranged after said at least one portion has been formed. The printing line comprises a conveyor 70 and a digital printer 80. The conveyor 70 is adapted to convey a substrate 1 through the printer 80. Optionally, the printing line may comprise a primer application device (not shown) adapted to apply a primer on the surface 2 of the substrate 1 prior to printing. The printing line may further comprise a heating device 90 adapted to heat the substrate 1 after printing. The printing line may further comprise a device for providing the substrate 1 with a protective layer or coating (not shown) after the printing.

The printer 80 may be an inkjet printer. Preferably, the printer is a DOD (Drop on Demand) piezo-electric inkjet printer. A thermal DOD inkjet printer may also be used. The décor is printed in a contactless manner.

The printer 80 comprises at least one print bar 81, 82, 83, 84. The print bar 81, 82, 83, 84 comprises at least one inkjet print head. Preferably, the printer 80 comprises several inkjet print heads. Preferably, the printer 80 comprises several print bars 81, 82, 83, 84. As an example, the printer 80 may comprise one print bar for each one of the CMYK colours, and/or one print bar for each spot colour. The number of print bars, print heads, and spot colours may vary.

The print bar or print bars 81, 82, 83, 84 is arranged on a fixed distance from the conveyor in a vertical direction. Thereby, the print bar or print bars 81, 82, 83, 84 is also arranged on a fixed distance from the surface 2 of the substrate 1 arranged on the conveyor 70.

Preferably, a number of print heads are arranged one after the other in a print bar 81, 82, 83, 84 extending perpendicular to the conveying direction D of the substrate 1 through printer. Print heads arranged in the same print bar 81, 82, 83, 84 preferably includes ink having the same colour. The width of the print bar 81, 82, 83, 84 preferably corresponds to the width of the substrate 1 on which the décor is to be printed. The print bars 81, 82, 83 and 84 are preferably stationary.

In the shown digital printer 80, a first, second, third and fourth print bar 81, 82, 83, 84 are arranged one after each other in the conveying direction D of the substrate. A first colour is applied by the print heads of the first print bar 81, a second colour is applied by the print heads of the second print bar 82, a third colour is applied by the print heads of the third print bar 83, and a fourth colour is applied by the print heads of the fourth print bar 84.

Alternatively, a printer 80 comprising a print head having different channels may be used. In this case, one print head may print one colour or several colours. Thereby, more than one colour can be printed by an individual print head provided with different channels. One channel is provided for each colour. Consequently, only the printer 80 may comprise only one print bar comprises several print colours.

The ink that is applied by means of the above described inkjet printer 80 may be an aqueous ink, a solvent-borne ink, or a UV based ink. The ink may be a pigment based ink or a dye based ink.

The ink that is applied by means of the above described inkjet printer 80 may be an aqueous pigment ink composition. The ink composition comprises pigments giving the ink its specific colour. Preferably, the aqueous ink composition is a heat activated curing ink. The ink composition may comprise a binder, water and pigment. The binder may for example be a polymer or cellulose. The binder may be dispersed in the ink composition. Alternatively, the pigment is coated by a binder, preferably a polymer. The polymer may carry carboxyl groups. The polymer may be styrene, acrylic or methacrylic polymer or copolymer, or unsaturated monomers, polyesters, vinyl polymers or copolymers, aromatic and aliphatic polyurethanes, or alkyd resins.

The décor that is to be printed on the substrate 1 may be both natural designs and patterns such as a wood pattern or stone pattern. The décor may also be a fantasy design or pattern.

The inkjet printer 80 is adapted to print a décor on the substrate 1. A primer may be applied on the substrate prior to printing.

The drop velocity of the print heads may be exceeding 8 m/s. It has been identified that 10-30 picolitres will still give an optically good printing result without getting a dotted impression of the print. In order to further improve the stand off, the drop velocity may be increased to 8 m/s or even more. With this it will be possible to jet from a distance of 2 mm and more, even up to 6 mm. The distance may be about 2 mm in the vertical direction form the main plane of the surface, or preferably exceed 2 mm. A drop volume of print heads of the print bar may be 10-30 picolitres. In one embodiment, a drop volume of print heads of the print bar is 10-30 picolitres and the print bar is positioned at a distance of at least 2 mm in a vertical direction from a main plane of the surface. By combining a drop volume of 10-30 picolitres with a distance of at least 2 mm, a sufficient resolution of the print is preserved, as well as the colour tone of the print.

Heat is applied to the print such that the water of the aqueous pigment ink composition evaporates. A heating device 90 may be arranged after the digital printer 80, as seen in the conveying direction D of the substrate 1. The heating device 90 may include infrared (IR) heating, near infrared (NIR) heating, heated air or a combination thereof.

After printing, the substrate 1 may be provided with a protective layer such as a coating, for example, a radiation curable coating, in any conventional manner. The coating may be applied by an ink jet print head (not shown). The coating may be applied by an ink jet print head on said at least one portion such as a bevel, grout line and/embossing. Superfluous coating fluid may be removed from said at least one portion such as a bevel, grout line and/or embossing. Superfluous coating may be removed before and/or after curing. Superfluous coating may be removed, for example, by scarping, sanding, air pressure, etc.

Figure 2:
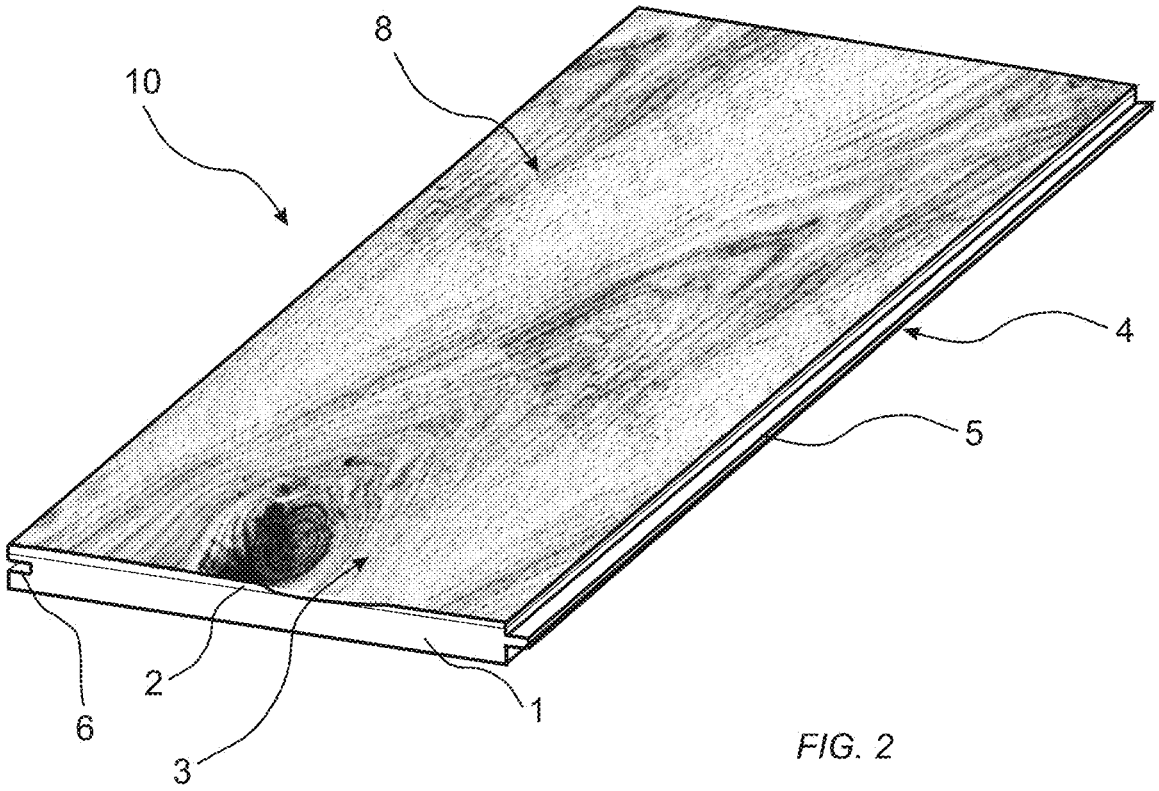
FIG. 2 shows a digitally printed substrate according to an embodiment.

FIG. 2 shows a substrate 1 according to an embodiment of the present invention. The substrate 1 is any type as described above with reference to FIG. 1. The substrate may be a building panel such as a floor panel as shown in FIG. 2. The building panel may comprise a mechanical locking system 4, as in the embodiment shown in FIG. 2.

The substrate 1 comprises at least one embossed portion 3 having an extension in a plane lower than the surface 2 of the substrate 1. The embossed portion 3 may be formed by pressing, brushing and/or embossing as described above with reference to FIG. 1. The embossed portion 3 has been formed prior to printing. The substrate 1 further comprises at least one protrusion 8 having an extension in a plane above the surface 2 of the substrate 1.

A décor is printed on the surface 2 of the substrate 1 by the ink jet printer 80 and method described above with reference to FIG. 1. Preferably, the décor is printed over the whole surface 2 of the substrate 1. The décor is printed in register with the at least one embossed portion 3 and the at least one protrusion 8.

The embossed portion 3 is printed with the décor, and the décor continuously extends over the surface 2 of the substrate 1 and into and over the embossed portion 3. The protrusion 8 is printed with the décor, and the décor continuously extends over the surface 2 of the substrate 1 and into and over the protrusion 8. Portions of both the embossed portion 3 and the protrusion 8 have an extension in the vertical direction as well as in the horizontal direction. By the drop velocity of the ink in the print head exceeding 8 m/s, surfaces positioned at different distances from the print bar 81, 82, 83, 84 has been printed by the same print bar 81, 82, 83, 84 in the same printing operation, without adjusting the distance between the print bar 81, 82, 83, 84 and the surface 2 to be printed. Furthermore, ink drops have also landed on portions having an extension in the vertical direction, such that side surface of the embossed portion 3 also have been printed. Turbulence may further facilitate for the ink drops to bond even on a vertical surfaces.

Figure 3:
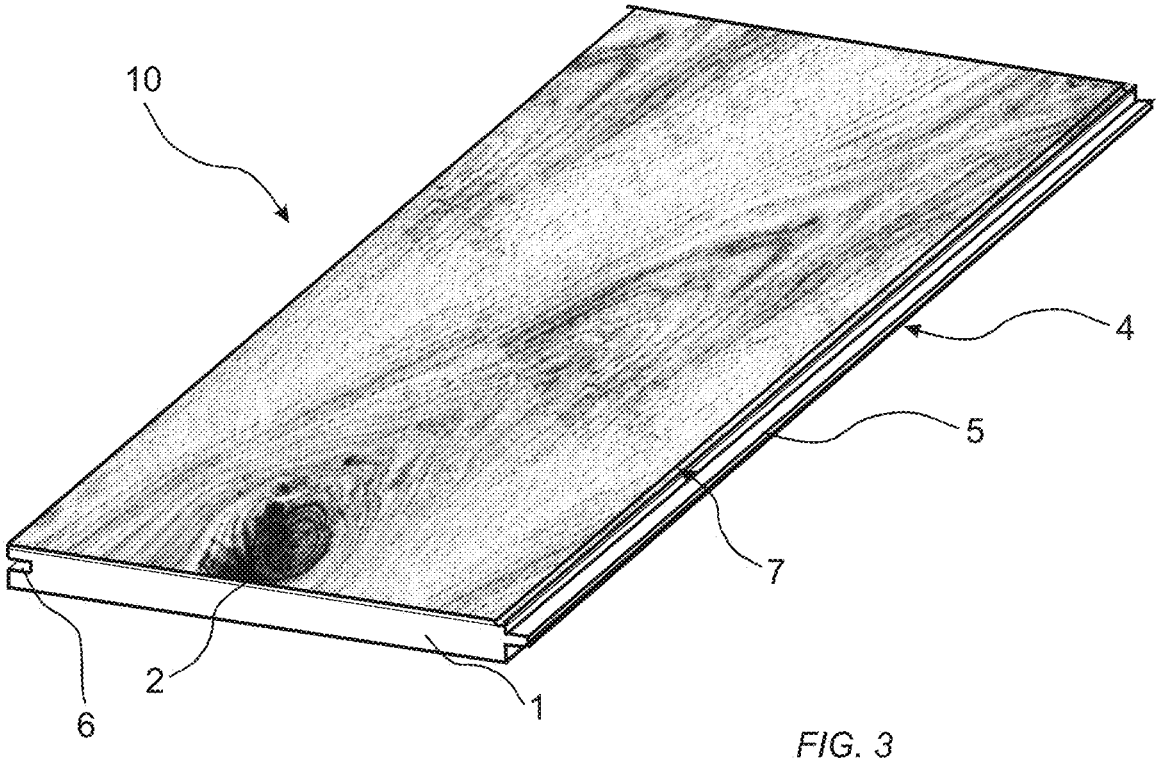
FIG. 3 shows a digitally printed substrate according to an embodiment.

FIG. 3 shows a substrate 1 according to an embodiment of the present invention. The substrate 1 is any type as described above with reference to FIG. 1. The substrate may be a building panel such as a floor panel as shown in FIG. 3. The building panel may comprise a mechanical locking system 4, as in the embodiment shown in FIG. 3.

The substrate 1 comprises a grout line 7 having an extension in a plane lower than the surface 2 of the substrate 1. The grout line 7 may have a circular, rectangular, U-shaped or V-shaped shape as seen in cross section. The grout line 7 may be formed by pressing or any kind of machining as described above with reference to FIG. 1. The grout line 7 has been formed prior to printing. Preferably, the grout line 7 extends along at least one edge of the substrate 1.

A décor is printed on the surface 2 of the substrate 1 by the printer and method described above with reference to FIG. 1. Preferably, the décor is printed over the whole surface 2 of the substrate 1.

The grout line 7 is printed with the décor, and the décor continuously extends over the surface 2 of the substrate 1 and into and over the grout line 7. Both portions of the grout line 7 have an extension in the vertical direction as well as in the horizontal direction. By the drop velocity of the ink in the print head exceeding 8 m/s, surfaces positioned at different distances from the print bar 81, 82, 83, 84 has been printed by the same print bar in the same printing operation, without adjusting the distance between the print bar and the surface 2 to be printed. Furthermore, ink drops have also landed on portions having an extension in the vertical direction, such that side surface of the grout line also have been printed. Turbulence may further facilitate for the ink drops to bond on a vertical surfaces.

Figure 4:
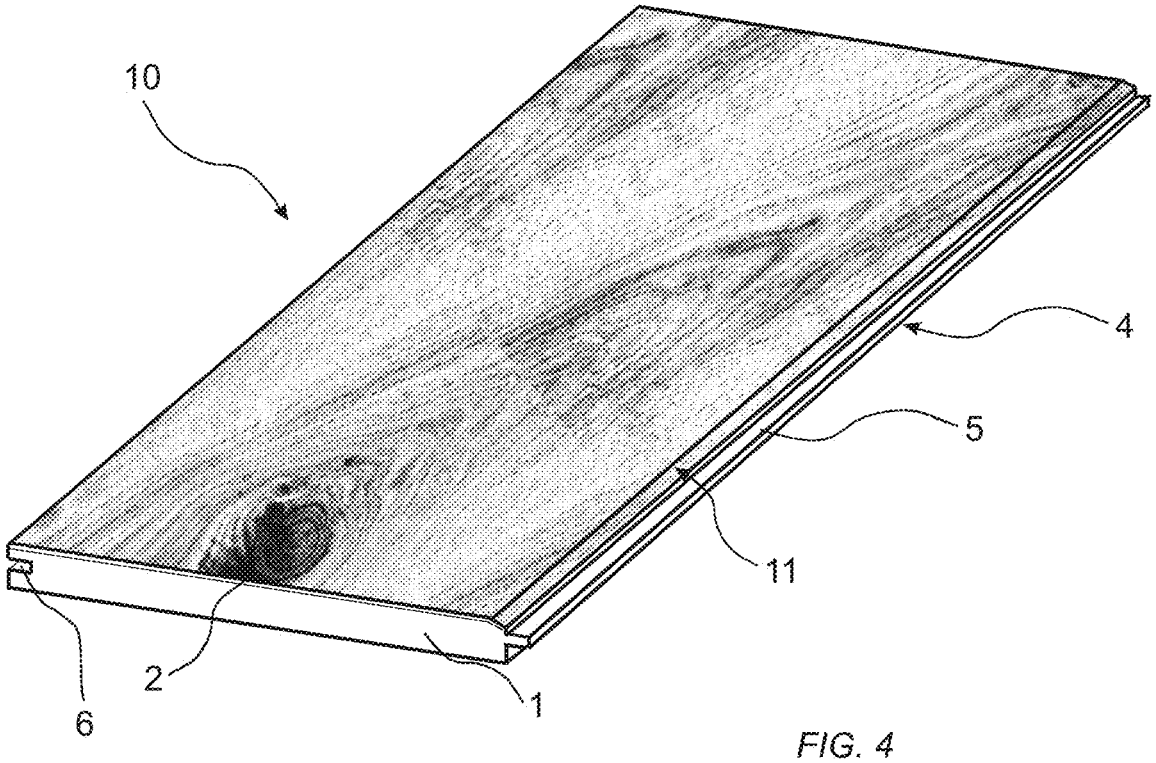
FIG. 4 shows a digitally printed substrate according to an embodiment.

FIG. 4 shows a substrate 1 according to an embodiment of the present invention. The substrate 1 is any type as described above with reference to FIG. 1. The substrate may be a building panel such as a floor panel as shown in FIG. 4. The building panel may comprise a mechanical locking system 4, as in the embodiment shown in FIG. 4.

The substrate 1 comprises a bevel 11 having an extension in a plane lower than the surface 2 of the substrate 1. The bevel 11 is preferably formed along at least one edge of the substrate 1. The bevel 11 may have a convex shape. The bevel 11 may be formed by pressing or any kind of machining as described above with reference to FIG. 1. The bevel 11 has been formed prior to printing.

A décor is printed on the surface 2 of the substrate 1 by the ink jet printer 80 and method described above with reference to FIG. 1. Preferably, the décor is printed over the whole surface 2 of the substrate 1.

The bevel 11 is printed with the décor, and the décor continuously extends over the surface 2 of the substrate 1 and over the bevel 11. By the drop velocity of the ink in the print head exceeding 8 m/s, surfaces positioned at different distances from the print bar 81, 82, 83, 84 has been printed by the same print bar in the same printing operation, without adjusting the distance between the print bar and the surface 2 to be printed.

Figure 5:
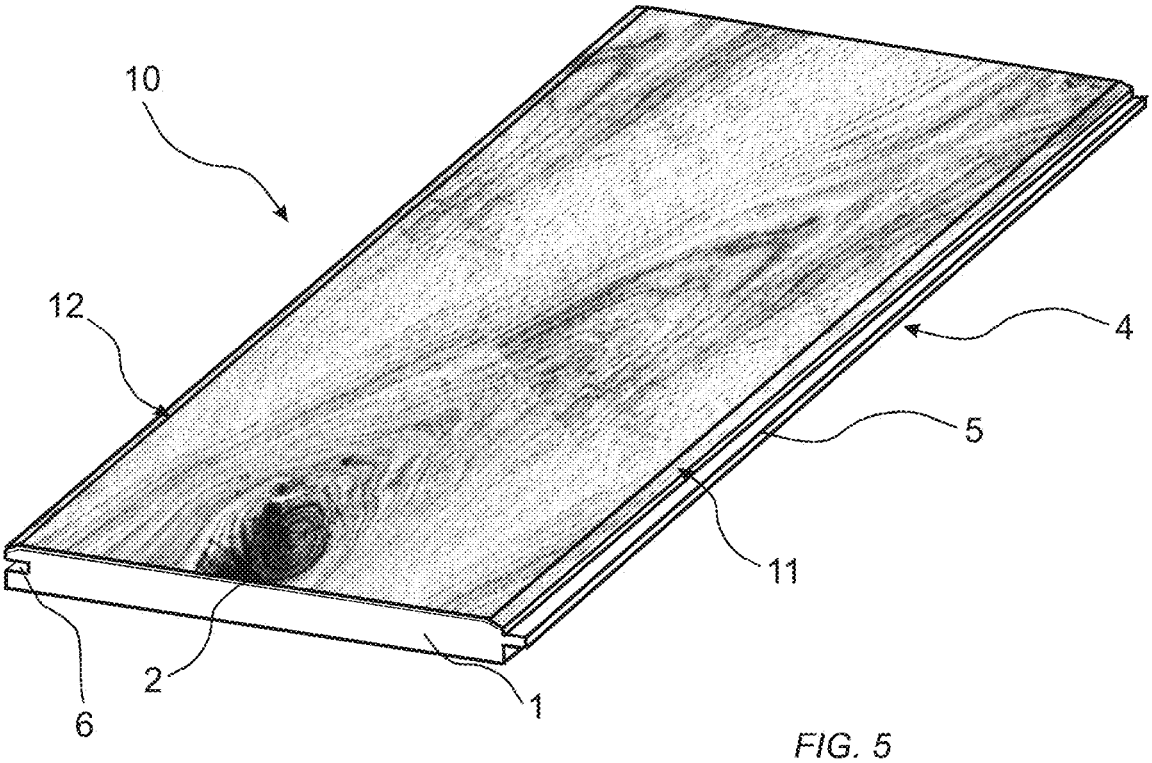
FIG. 5 shows a digitally printed substrate according to an embodiment.

FIG. 5 shows a substrate 1 according to an embodiment of the present invention. The substrate 1 is any type as described above with reference to FIG. 1. The substrate may be a building panel such as a floor panel, a wall panel, a ceiling panel, a furniture component, worktop, etc. The substrate 1 comprises a mechanical locking system 4. The mechanical locking system 4 may comprise at least a tongue 5 along a first edge of the substrate 1 and a tongue groove 6 along a second edge of the substrate 1. In the embodiment shown in FIG. 5, the first edge and the second edge are arranged opposite each other. The mechanical locking system 4 is formed prior to printing the substrate.

The substrate 1 further comprises a first bevel 11 extending along the first edge of the substrate 1. The substrate 1 further comprises a second bevel 12 extending along the second edge of the substrate 1. The bevels 11, 12 have an extension in a plane lower than the surface 2 of the substrate 1. The bevels 11, 12 have a convex shape. The bevels 11, 12 are preferably formed along one edge of the substrate 1. The bevels 11, 12 may be formed by pressing or any kind of machining as described above with reference to FIG. 1. The bevels 11, 12 have been formed prior to printing.

A décor is printed on the surface 2 of the substrate 1 by the inkjet printer 80 and method described above with reference to FIG. 1. Preferably, the décor is printed over the whole surface 2 of the substrate 1.

The bevels 11, 12 are printed with the décor, and the décor continuously extends from the first bevel 11 over the surface 2 of the substrate 1 and to and over the second bevel 12. By the drop velocity of the ink in the print head exceeding 8 m/s, surfaces positioned at different distances from the print bar 81, 82, 83, 84 has been printed by the same print bar in the same printing operation, without adjusting the distance between the print bar 81, 82, 83, 84 and the surface 2 to be printed.

Furthermore, the décor continuously extends over the first bevel 11 and into and over the tongue 5 at the first edge in the embodiment shown in FIG. 5. Preferably, at least some ink drops have landed on an edge surface of the first edge extending in the vertical direction. In an embodiment wherein the substrate 1 comprises a surface layer of wood veneer arranged on wood-based board, and wherein the tongue 5 is formed in the wood-based board, by the décor extending over the tongue 5, a visual impression of a solid substrate 1 may be formed.

A person skilled in the art appreciates that embodiments described above with reference to FIGS. 2-5 may be combined. A person skilled in the art also appreciates that the décor may extend over the tongue 5 of the mechanical locking system without requirement of a bevel 11, 12.

Figure 6:
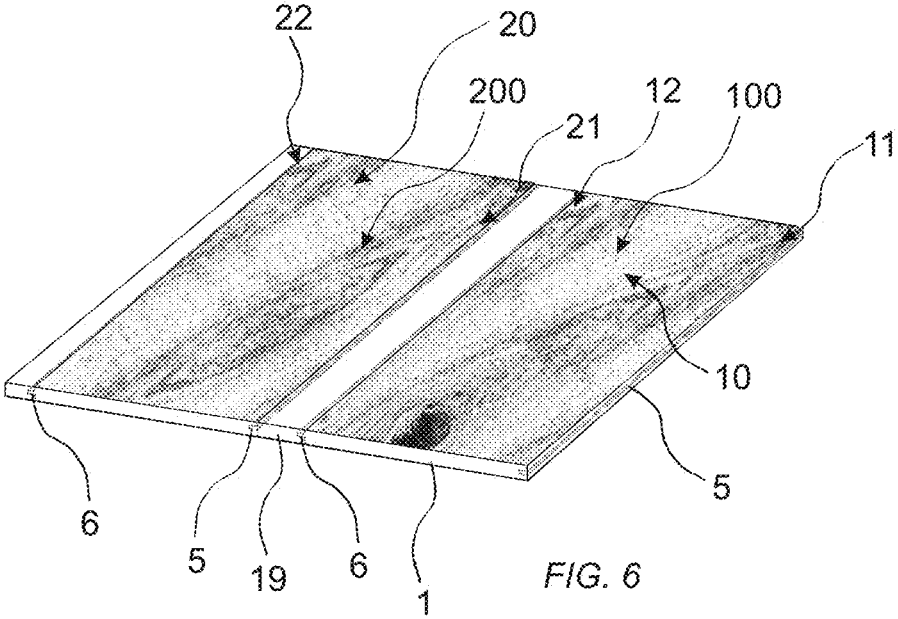
FIG. 6 shows a digitally printed substrate according to an embodiment.

FIG. 6 illustrates a method of forming a décor on substrate 1 intended to form at least two building panels 10, 20, 30. The building panels 10, 20, 30 may be floor panels, wall panels, ceiling panels, door panels, furniture components, etc. The method comprises providing a substrate 1 having a surface 2. The surface 2 may comprise a wood veneer, solid wood, a wood-based material, a thermoplastic foil, a co-extruded thermoplastic layer, a paper, non-woven, wallpaper, etc. The substrate 1 may be solid, or may comprise a surface layer and a core, wherein the surface layer is arranged on the core and forms the surface of the substrate. The core may comprise be a wood-based board, for example, a wood-fibre based board such as MDF or HDF, or plywood. The core may be a Wood Plastic Composite (WPC). The core may be a mineral composite board. The core may be a fibre cement board. The core may be magnesium oxide cement board. The core may be a plastic board such as a thermoplastic board. The core may be formed of solid wood. The core may be a lamella core. Examples of suitable thermoplastic materials for the surface and/or the core is polyvinyl chloride (PVC), polypropylene (PP), and/or polyethylene (PE).

The substrate 1 may be a board prepared for printing, for example, a wood-based board with a surface coated with a layer adapted to receive a print.

The method may comprise forming bevels (not shown) as described above with reference to FIG. 5, such as a first bevel and a second bevel separated by a predetermined distance forming a gap 19 between the first and the second bevel. Preferably, the first and second bevels are extending parallel with each other. The bevels may be formed by any conventional method such as pressing, embossing, machining, profiling, sanding, scarping, or any other type of machining.

A décor is printed by an inkjet printer 80 as described above with reference to FIG. 1. The décor is printed on the surface 2 of the substrate 1 adapted form a surface 100 of a first panel 10 and a surface 200 of a second panel 20. The portions of the surface 2 of the substrate 1 adapted to form the surface 100 of the first panel 10 and the surface 200 of the second panel 20, respectively, are separated by a gap 19. The décor printed on a second portion 12 of the first panel 10 is synchronized with a first portion 21 of the second panel 20. The décor is printed by a common print bar 81, 82, 83, 84 as described above with reference to FIG. 1. The print bar 81, 82, 83, 84 is arranged on a fixed distance from the surface 2 of the substrate 1. The print bar 81, 82, 83, 84 may be stationary. By the drop velocity of the ink in the print head exceeding 8 m/s, surfaces positioned at different distances from the print bar 81, 82, 83, 84 has been printed by the same print bar in the same printing operation, without adjusting the distance between the print bar and the surface to be printed.

Figure 7A:
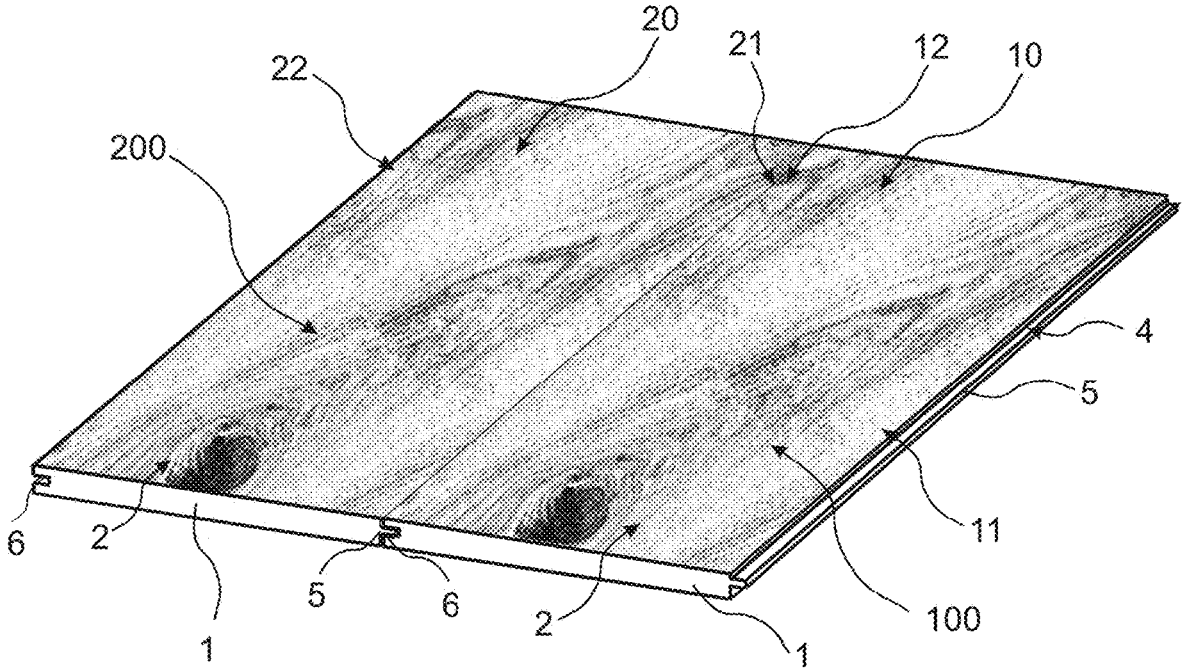
FIG. 7 shows a set of building panels joined together according to an embodiment of the invention.

The décor continuously extends over the surface 2 of the substrate adapted to form the surface 100 of the first panel 10 to the second portion 12. Further, the décor of the second portion 12 is synchronized with the décor of the first portion 21, and further the décor of the surface 2 of the substrate 1 adapted to form the surface 200 of the second panel 20. No décor may be present in the gap 19. The width of the gap 19 may correspond to the width required to form a mechanical locking system 4. After the décor has been printed, a first panel 10 and a second panel 20 may be formed by dividing the substrate 1 at the gap 19, such that a first and a second panels 10, 20 are formed. When the first panel 10 and the second panel 20 are arranged adjacent each other, the second edge portion 12 to the first edge portion 21, the décor continuously extends from the surface 100 of the first panel 10 to the surface 200 of the second panel 20 via the first and the second edge portions 21, 12, as shown in FIG. 7*a*. The décor of the second edge portion 12 is synchronized with the décor of the first edge portion 21.

The method may further comprise forming a mechanical locking system 4 at said gap 19. The mechanical locking system 4 may be of different types. The mechanical locking system 4 may comprise a tongue 5 at said first edge and tongue groove 6 at said second edge adapted to lock the first and second panels 10, 20 in a vertical direction. The mechanical locking system 4 may comprise a tongue 5 at said first edge adapted to cooperate with a tongue groove 6 at said second edge for locking the panels in a vertical direction, and locking strip at said second edge adapted to cooperate with a locking groove at said first edge (not shown). Alternatively, the mechanical locking system may comprise a separate flexible tongue (not shown). The mechanical locking system may be any of the types disclosed in WO 2007/015669, WO 2008/004960, WO 2009/116926, or WO 2010/087752. The panels 10, 20 may be provided with a mechanical locking system along long edges only, or along both long edges and short edges.

When the first and the second panel 10, 20 are joined by means of the mechanical locking system 4, the second edge portion 12 to the first edge portion 21, as shown in FIG. 7*a*, the décor continuously extends from the surface of the first panel 10 to the surface of the second panel 20 via the second and the first edge portions 12, 21, as shown in FIG. 7*a*. The décor of the second edge portion 12 of the first panel 10 is synchronized with the décor of the first edge portion 21 of the second panel 20. The first and second panels 10, 20 may also be provided with bevels (not shown), wherein a décor of a bevel along the second edge portion 12 of the first panel 10 is synchronized with a décor of a bevel along the first edge portion 21 of the first panel 20.

Figure 7B:
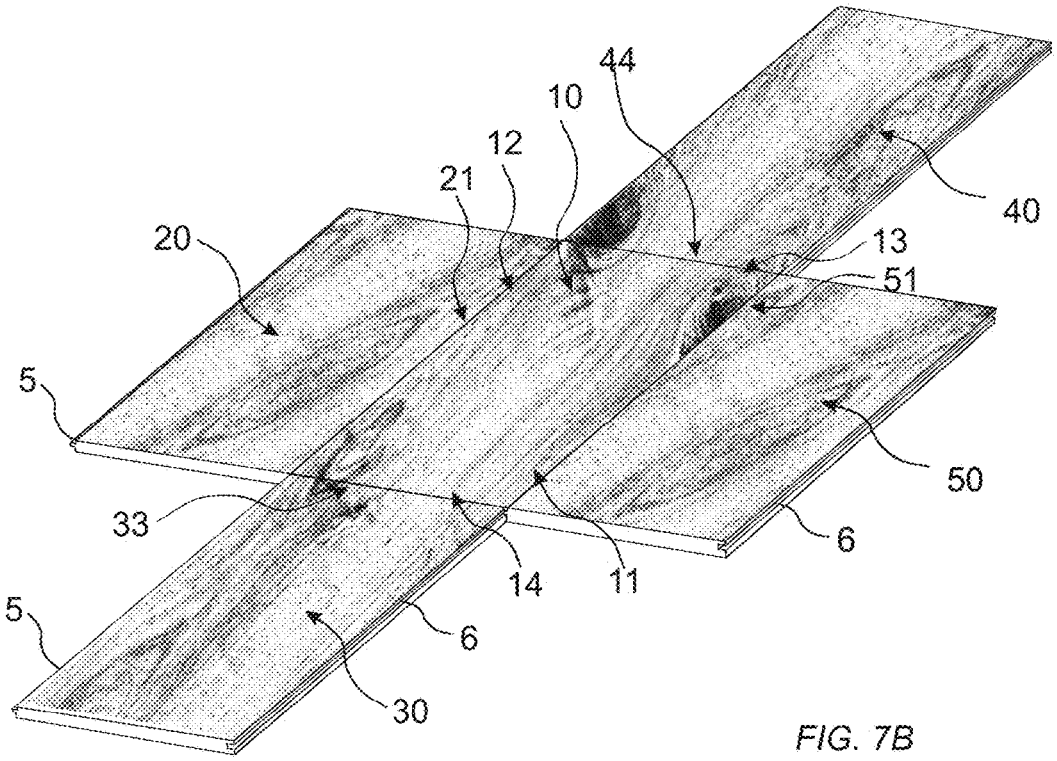

In the embodiment shown in FIG. 7*b*, the décor of the first panel 10 is synchronized along all four edge portions of the panel 10. The set of building panels shown in FIG. 7*b* comprises the first and the second panel 10, 20 described above with reference to FIG. 7*a*, a third panel 30, a fourth panel 40 and a fifth panel 50, wherein the third, fourth and fifth panel 30, 40, 50 are of the same type as the first and second panel 10, 20 described above. The third panel 30 comprises a third edge portion 33 of the third panel 30. The fourth panel 40 comprises a fourth edge portion 44 of the fourth panel 40. The fifth panel 50 comprises a second edge portion 51 of the fifth panel 50. All edge portions are printed with the décor. The décor of the first edge portion 11 of the first panel 10 is synchronized with the décor of the second edge portion 51 of the second panel 50. The décor of the second edge portion 12 of the first panel 10 is synchronized with the décor of the first edge portion 21 of the fifth panel 20. The décor of the third edge portion 13 of the first panel 10 is synchronized with the décor of the fourth edge portion 44 of the fourth panel 40. The décor of the fourth edge portion 14 of the first panel 10 is synchronized with the décor of the third edge portion 33 of the third panel 30. As shown in FIG. 7 *b*, when joined, the décor continuously extends from the first panel 10 over to the second, third, fourth and fifth panel 20, 30, 40, 50.

In the embodiment shown in FIG. 7*b*, the first and second edges portions are long edges of the panels, and the third and fourth edges portions are short edges of the panels.

The edge portions 11, 12, 13, 14, 22, 33, 44, 51 may also be provided with bevels (not shown) along the edge portions.

A person skilled in the art appreciates that the panels joined together in FIGS. 7*a-b* may also been produced individually as disclosed above with reference to FIG. 1 as well as been produced by the method described with reference to FIG. 6.

It is contemplated that there are numerous modifications of the embodiments described herein, which are still within the scope of the invention as defined by the appended claims. For example, it is contemplated that the panels and/or on the package may be provided with a sign indicating which panels match.

For example, it is contemplated that the mechanical locking system described above may be adapted to lock in a vertical direction only, or lock in a vertical and horizontal direction.

Example 1

A building panel comprising a HDF core and a maple veneer having a thickness of 2 mm arranged on the HDF core was provided. The building panel comprises a mechanical locking system along the edges. At the long side edges, bevels having a concave shape were arranged adjacent the mechanical locking system. The bevels have a depth of 2 mm, i.e. extending into the entire thickness of the maple veneer. The surface of the maple veneer was provided with embossed portions having a depth of maximum 1 mm. The distance in the vertical direction from the highest protruding portions of the surface to the print heads was 3 mm, i.e. the stand off was 3 mm from the highest located portions.

A décor file was printed over the surface of the maple veneer, including embossed portions and protruding portions and the bevels at the long side edges. The décor was printed by a single-pass printer and with a drop volume of the print heads of 10-30 picolitres.

A high quality print was obtained, with desired resolution and colour tone. At the deepest located embossed portions (located at a vertical distance of 5 mm from the print heads), a slight colour tone shift towards the darker range was noticed.

Example 2

A set of building panels were provided, each comprising a HDF core and a maple veneer having a thickness of 2 mm arranged on the HDF core. The building panels were joined to each other, long side edge to long side, by means of a mechanical locking system. The long side edges of the panels were provided with bevels having a concave shape and a depth of 2 mm, i.e. extending into the entire thickness of the maple veneer.

A décor including a logotype was printed on the surface of both panels, including the bevels. The décor including the logotype was printed such that the logotype was continuously extending from the surface of the first panel, over the bevel of the first panel to the bevel of the second panel and over the surface of the second panel. Thereby, the logotype was continuously extending over the panels and the joined long side edges of the panels, such that an impression of a single panel is obtained. The décor including the logotype was printed by a single-pass printer and with a drop volume of the print heads of 10-30 picolitres.

The invention claimed is:

1. A method for forming a décor on a substrate, comprising providing a substrate having a surface, forming at least one portion in the surface of the substrate, the at least one portion having an extension in a plane situated lower than or above a plane of the surface of the substrate, digital printing a décor on the surface of the substrate, and on said at least one portion, with a single-pass printer comprising at least one common print bar, wherein the common print bar is fixedly arranged at least 2 mm above the surface of the substrate, wherein the common print bar comprises print heads with a drop volume between 10-30 picoliters, and wherein the décor continuously extends over the surface of the substrate and said at least one portion.

2. The method according to claim 1, wherein the décor is present on said at least one portion.

3. The method according to claim 1, wherein said at least one portion in the surface of the substrate has an extension in a direction inclined in relation to the surface of the substrate.

4. The method according to claim 1, wherein said at least one portion forms a bevel along an edge of the substrate.

5. The method according to claim 4, wherein the bevel has a convex shape.

6. The method according to claim 1, wherein said at least one portion forms an embossed portion in the surface of the substrate.

7. The method according to claim 1, wherein said at least one portion forms a grout line in the surface of the substrate.

8. The method according to claim 1, wherein said at least one portion forms a protruding portion in the surface of the substrate.

9. The method according to claim 1, wherein said substrate comprises a core and a surface layer arranged on the core, said surface layer forming said surface of the substrate, and wherein said at least one portion is formed in the surface layer.

10. The method according to claim 9, wherein said at least one portion is formed in the surface layer only.

11. The method according to claim 1, wherein a position of the print bar in a vertical direction is fixed during printing.

12. The method according to claim 1, wherein a drop velocity of print heads of the print bar exceeds 8 m/s.

13. The method according to claim 1, wherein the print bar comprises one or several Piezo print heads.

14. The method according to claim 1, wherein said surface comprises a wood veneer, solid wood, a wood-based material, a thermoplastic foil, a co-extruded thermoplastic layer, paper, or non-woven.

15. The method according to claim 1, further comprising forming a mechanical locking system at at least one edge of the substrate prior to printing.

16. The method according to claim 15, further comprising digital printing on at least one surface of the mechanical locking system.

17. The method according to claim 15, wherein the mechanical locking system comprises a tongue at at least one edge of the substrate, and wherein the step of digital printing comprises printing said décor on the tongue with the common print bar, wherein the décor is continuously extending over the surface of the substrate, said at least one portion and the tongue.

18. A method for forming a décor on a substrate, comprising providing a substrate having a surface, forming at least one portion in the surface of the substrate, the at least one portion having an extension in a plane situated lower than or above a plane of the surface of the substrate, digital printing a décor on the surface of the substrate, and on said at least one portion by at least one common print bar, wherein the décor continuously extends over the surface of the substrate and said at least one portion, wherein the step of forming at least one portion comprises forming a first portion in the surface of the substrate having an extension in a plane situated lower than or above a plane of the surface of the substrate and forming a second portion in the surface of the substrate having an extension in a plane situated lower than or above a plane of the surface of the substrate, wherein the first and the second portion are separated by a predetermined distance forming a gap, and wherein the step of digital printing a décor comprises digital printing the décor on the surface of the substrate, said first portion and said second portion by the common print bar, dividing the substrate at said gap for forming a first panel and a second panel, and forming a mechanical locking system at said gap, wherein when the first panel and the second panel are joined by the mechanical locking system, the décor on said first portion is synchronized with the décor on said second portion such that the décor of the first portion continuously extends into the décor of the second portion.

19. The method according to claim 18, wherein no décor is printed in the gap.

20. The method according to claim 18, wherein the first portion is provided along an edge of the first panel and the second portion is provided along an edge of the second panel.

21. A building panel, comprising a substrate having a surface, at least one portion in the surface of the substrate having an extension in a plane situated lower than or above a plane of the surface of the substrate, wherein the surface and said at least one portion are provided with a décor, wherein the décor is continuously extending over the surface of the substrate and said at least one portion, wherein the décor is prepared by digital printing on the surface of the substrate and on said at least one portion by at least one common print bar of a single-pass printer, wherein the common print bar is fixedly arranged at least 2 mm above the surface of the substrate, wherein the common print bar comprises print heads with a drop volume between 10-30 picoliters.

22. A method of forming a décor on a substrate, comprising providing a substrate having a surface, digital printing a décor on a first portion and a second portion of said surface, wherein the first and second portions are separated by a predetermined distance forming a gap, and dividing the substrate at the gap to form a first panel and a second panel and forming a mechanical locking system from a portion of the gap, wherein the décor of the first portion is synchronized with the décor of the second portion and continuously extends into the décor of the second portion when the first portion is placed adjacent to the second portion.

23. The method according to claim 22, wherein the décor on the first portion and second portion is printed by at least one common print bar.

24. The method according to claim 22, wherein no décor is printed in the gap.

25. The method according to claim 22, further comprising connecting the first and the second panel by means of the mechanical locking system, wherein the décor of the first portion is synchronized with the décor of the second portion and continuously extends into the décor of the second portion after joining.

26. The method according to claim 23, wherein a position of the at least one common print bar is in a fixed vertical direction during printing.

27. The method according to claim 23, wherein the at least one common print bar is fixedly arranged.

28. The method according to claim 23, wherein a drop velocity of print heads of the at least one common print bar exceeds 8 m/s.

29. The method according to claim 23, wherein a drop volume of print heads of the at least one common print bar is 10-30 picolitres.

30. The method according to claim 23, wherein the at least one common print bar comprises one or several Piezo print heads.

31. The method according to claim 22, wherein said surface comprises a wood veneer, solid wood, a wood-based material, a thermoplastic foil, a co-extruded thermoplastic layer, paper, non-woven.

32. The method according to claim 22, wherein the predetermined distance corresponds to a horizontal extension of the mechanical locking system.

33. A set of building panels, comprising a first panel and a second panel, wherein the first panel and the second panel are provided with a digitally printed décor, wherein the first panel and the second panel further comprise a mechanical locking system formed from a gap between the first and second panel, and wherein the décor of the first panel and the décor of the second panel are synchronized such that the décor is continuously extending over the first panel to the second panel when the first and second panels are joined, wherein the décor is prepared by digital printing on the surface of the first panel and the second panel and on at least one portion of the first and second panels by at least one common print bar, wherein the at least one portion has an extension into a plane situated lower than or above a plane of the surface of the first and second panels.

* * * * *